US008760245B2

(12) United States Patent
Mina et al.

(10) Patent No.: US 8,760,245 B2
(45) Date of Patent: Jun. 24, 2014

(54) COPLANAR WAVEGUIDE STRUCTURES WITH ALTERNATING WIDE AND NARROW PORTIONS HAVING DIFFERENT THICKNESSES, METHOD OF MANUFACTURE AND DESIGN STRUCTURE

(75) Inventors: Essam Mina, South Burlington, VT (US); Guoan Wang, South Burlington, VT (US); Wayne H. Woods, Jr., Burlington, VT (US)

(73) Assignee: International Business Machines Corporation, Armonk, NY (US)

( * ) Notice: Subject to any disclaimer, the term of this patent is extended or adjusted under 35 U.S.C. 154(b) by 719 days.

(21) Appl. No.: 12/959,997

(22) Filed: Dec. 3, 2010

(65) Prior Publication Data

US 2012/0139667 A1 Jun. 7, 2012

(51) Int. Cl.
*H01P 3/08* (2006.01)
*H01P 9/00* (2006.01)

(52) U.S. Cl.
CPC . *H01P 3/081* (2013.01); *H01P 9/00* (2013.01)
USPC ..... 333/238; 333/34; 333/161

(58) Field of Classification Search
CPC ..... H01P 3/081; H01P 9/00
USPC ..... 333/1, 4, 5, 34, 161, 204, 238
See application file for complete search history.

(56) References Cited

U.S. PATENT DOCUMENTS

| | | | | |
|---|---|---|---|---|
| 5,150,436 | A | 9/1992 | Jaeger et al. | |
| 5,291,162 | A | 3/1994 | Ito et al. | |
| 5,459,633 | A | 10/1995 | Kosslowski et al. | |
| 5,869,429 | A | 2/1999 | Das | |
| 5,952,901 | A | 9/1999 | Nakano | |
| 6,023,209 | A | 2/2000 | Faulkner et al. | |
| 6,570,464 | B1 * | 5/2003 | Tanabe et al. | 333/34 |
| 6,650,192 | B2 | 11/2003 | Hayashi | |
| 6,794,947 | B2 | 9/2004 | Lin | |
| 7,245,195 | B2 * | 7/2007 | Satoh et al. | 333/204 |
| 8,193,880 | B2 * | 6/2012 | Cho et al. | 333/238 |
| 2005/0093737 | A1 | 5/2005 | Schoebel | |
| 2006/0044073 | A1 | 3/2006 | Stoneham | |
| 2006/0158286 | A1 | 7/2006 | Lai et al. | |
| 2008/0048799 | A1 | 2/2008 | Wang et al. | |

FOREIGN PATENT DOCUMENTS

WO WO 8302687 8/1983

OTHER PUBLICATIONS

Sun et al., "A Compact Branch-Line Coupler Using Discontinuous Microstrip Lines", IEEE Microwave and Wireless Components Letters, vol. 15, No. 8, Aug. 2005, pp. 519-520.

Seki et al., "Cross-Tie Slow-Wave Coplanar Waveguide on Semi-Insulating GaAs Substrates", Electronic Letters, vol. 17, No. 25, Dec. 10, 1981, pp. 940-941.

(Continued)

*Primary Examiner* — Benny Lee

(74) *Attorney, Agent, or Firm* — Anthony Canale; Roberts Mlotkowski Safran & Cole, P.C.

(57) ABSTRACT

On-chip high performance slow-wave coplanar waveguide structures, method of manufacture and design structures for integrated circuits are provided herein. The structure includes at least one ground and signal layer provided in a same plane as the at least one ground. The signal layer has at least one alternating wide portion and narrow portion with an alternating thickness. The wide portion extends toward the at least one ground.

20 Claims, 11 Drawing Sheets

(56) References Cited

OTHER PUBLICATIONS

Wang et. al., "Novel Low-Cost On-Chip CPW Slow-Wave Structure for . . . Applications", Electronic Components and Technology Conference, 2008, pp. 186-190.
Ma et al., "Experimentally Investigating . . . Periodic Cells", IEEE, 2005, (4 pages).
Cheung et al., "Shielded Passive Devices . . . Circuits", IEEE Journal of Solid-State Circuits, vol. 41, No. 5, May 2006, pp. 1183-1200.
Wu et al., "Hybrid-Mode Analysis of . . . Lines", IEEE Transactions on Microwave Theory and Tech., vol. 39, No. 8, Aug. 1991, pp. 1348-1360.
Tilmans et al., "MEMS for wireless communications . . . RF-MEMS-SiP", J. Micromech. Microeng. 13 (2003), pp. S139-S163.
Ponchak, "RF Transmission Lines on Silicon Substrates", 29th European Microwave Conf. Digest, Oct. 1999, (4 pages).
Sakagami et al., "A Reduced Branch-Line Coupler with Eight Stubs", 1997 Asia Pacific Microwave Conf., pp. 1137-1140.
Sor et al., "A Novel Low-Loss . . . Filter Applications", IEEE, 2001, 4 pages.
Martin et al., "Dual Electromagnetic Bandgap CPW Structures for Filter Applications", IEEE Microwave and Wireless Components Letters, vol. 13, No. 9, Sep. 2003, pp. 393-395.
Application as filed for U.S. Appl. No. 12/752,554, filed Apr. 1, 2010.

* cited by examiner

COPLANAR WAVEGUIDE STRUCTURES WITH ALTERNATING WIDE AND NARROW PORTIONS HAVING DIFFERENT THICKNESSES, METHOD OF MANUFACTURE AND DESIGN STRUCTURE

FIELD OF THE INVENTION

The invention generally relates to waveguide structures and, in particular, to on-chip high performance slow-wave coplanar waveguide structures, methods of manufacture and design structures for integrated circuits.

BACKGROUND

In circuit design, passive components refer to components that are not capable of power gain such as, for example, capacitors, inductors, resistors, diodes, transmission lines and transformers. In circuit design for communications systems, for example, a large area of the board is taken up by passive devices. For example, 90-95% of components in a cellular telephone are passive components, taking up approximately 80% of the total transceiver board, which accounts for about 70% of the cost. To reduce the space taken up by the passive devices, very small discrete passive components and the integration of the passive components are under development.

Multi-chip module, system on chip (SOC)/system on package (SOP) in which the passive devices and interconnects are incorporated into the carrier substrate offer an attractive solution to further increase the integration. For example, SOC is a fully integrated design with RF passive devices and digital and analog circuits on the same chip. Their operation on CMOS grade silicon, however, is degraded by the high loss of transmissions lines and antennas. On the other hand, BiCMOS technologies present a cost effective option to realize highly integrated systems combining analog, microwave design techniques, transmission lines and other passive components.

In any event, many efforts have been made to reduce the size of the passive devices. For example, to reduce the space taken up by the passive components, discrete passive components have been replaced with on-chip passive components. However, size reduction of passive components may depend at least in part on the further development of on-chip interconnects, such as slow-wave coplanar waveguide (CPW) structures, for microwave and millimeter microwave integrated circuits (MICs), microwave and millimeter monolithic microwave integrated circuits (MMICs), and radiofrequency integrated circuits (RFICs) used in communications systems. In particular, interconnects that promote slow-wave propagation can be employed to reduce the sizes and cost of distributed elements to implement delay lines, variable phase shifters, branchline couplers, voltage-tunable filters, etc. However, advanced coplanar waveguide structures are needed for radiofrequency and microwave integrated circuits to serve as interconnects that promote slow-wave propagation, as well as related design structures for radio frequency and microwave integrated circuits.

Accordingly, there exists a need in the art to overcome the deficiencies and limitations described hereinabove.

SUMMARY

In a first aspect of the invention, a structure comprises at least one ground and a signal layer provided in a same plane. The signal layer has at least one alternating wide portion and narrow portion with an alternating thickness. The wide portion extends toward the at least one ground.

In an another aspect of the invention, a slow wave coplanar waveguide (CPW) structure comprises a signal layer having portions with different thicknesses T1, T2. The structure further comprises at least one ground line adjacent to the signal layer which includes one of: portions of different thicknesses corresponding in size and within a same plane as the different thicknesses T1, T2 of the signal layer; and a uniform thickness.

In yet another aspect of the invention, a method of tuning a coplanar waveguide structure, comprises tuning at least one of a capacitance and inductance of the coplanar waveguide structure by adjusting a thickness and spacing between at least one of a wide portion and a narrow portion of a signal layer, and a ground which is in a same plane as the signal layer.

In another aspect of the invention, a design structure tangibly embodied in a machine readable storage medium for designing, manufacturing, or testing an integrated circuit is provided. The design structure comprises the structures of the present invention. In further embodiments, a hardware description language (HDL) design structure encoded on a machine-readable data storage medium comprises elements that when processed in a computer-aided design system generates a machine-executable representation of the coplanar waveguide structure (CPW), which comprises the structures of the present invention. In still further embodiments, a method in a computer-aided design system is provided for generating a functional design model of the CPW. The method comprises generating a functional representation of the structural elements of the CPW.

BRIEF DESCRIPTION OF THE SEVERAL VIEWS OF THE DRAWINGS

The present invention is described in the detailed description, which follows, in reference to the noted plurality of drawings by way of non-limiting examples of exemplary embodiments of the present invention.

DETAILED DESCRIPTION

Figure 1A:
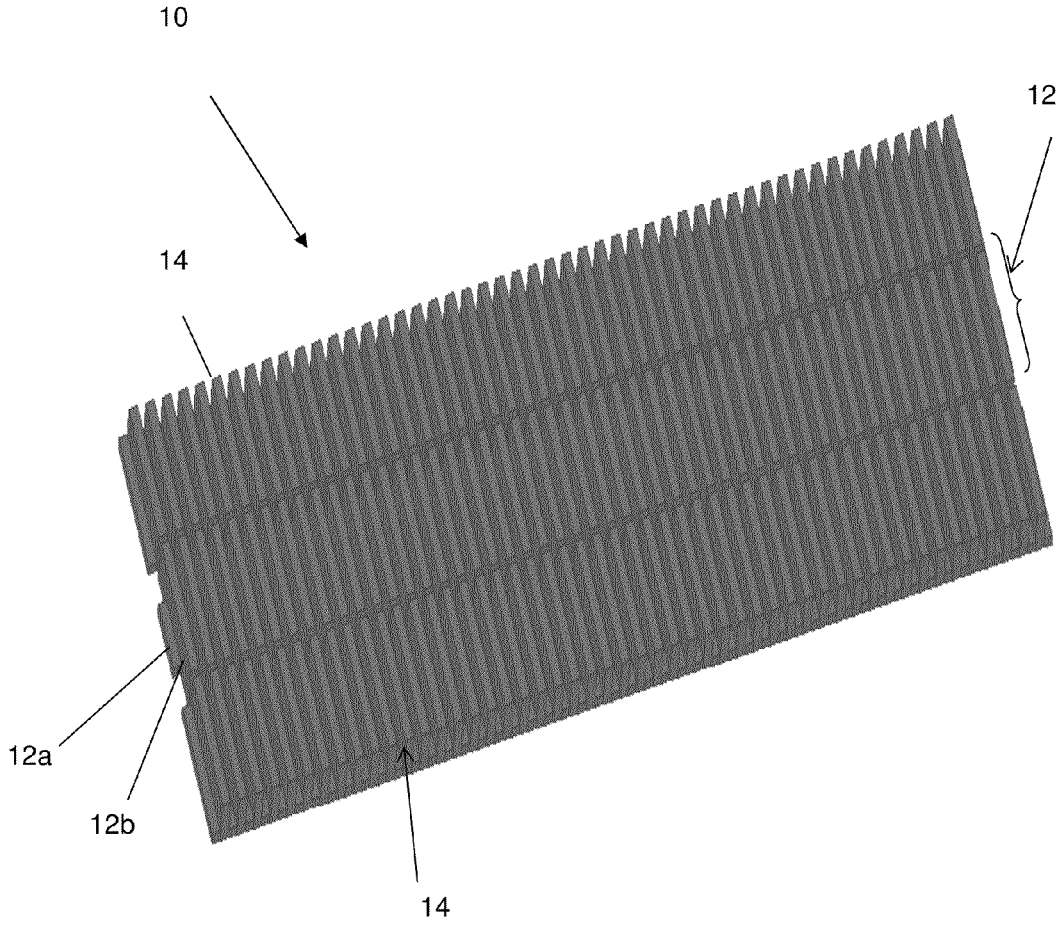
FIGS. 1*a* and 1*b* show a slow-wave coplanar waveguide structure in accordance with aspects of the invention.

The invention generally relates to waveguide structures and, in particular, to on-chip high performance slow-wave coplanar waveguide structures, methods of manufacture and design structures for integrated circuits. In embodiments, the present invention provides a compact on-chip slow-wave coplanar waveguide (CPW) structure that has more design flexibility to achieve improved slow-wave effects, compared to conventional structures. For example, the present invention provides ideal on-chip slow-wave structures with low losses and improved characteristic impedance, while utilizing considerably less board area than conventional systems. Advantageously, the CPW structure can be fabricated using conventional CMOS fabrication technology using multi-layer structures in current standard semiconductor processes.

In embodiments, the CPW structure of the present invention includes a signal layer comprising a plurality of cells, where each cell has a narrow (W1) portion and a wide (W2) portion, in an alternating arrangement. In embodiments, the CPW structure also includes, for example, different dimension wires, T1, T2 (e.g., thicker and thinner dimensions) for the signal layer and, in embodiments, ground wires. In alternate embodiments, the signal layer can have a constant width, with different thicknesses, T1, T2. The CPW structure can also include a cross-under and/or cross-over layer, which may connect with ground through the use of vias, the crossing layers are under and/or above the wide portion of the signal cell. The ground can also include short and long portions, coinciding respectively with the narrow and wide portions of the signal layer, also of alternating dimensions T1*a*, T2*a* (e.g., thicker and thinner dimensions).

In embodiments, the CPW structures can be adjusted by using different W1, W2, T1, T2 values and W1/W2 and/or T1/T2 ratios, different separations, pitch, and/or adding floating strips above and below the CPW structures. That is, the slow-wave effect of the CPW structures can be tuned by, for example, (i) changing the pitch of each cell;

(ii) changing the width difference ratio of the signal layer which results in a change of the separation between the signal layer and ground;

(iii) changing the thicknesses of the signal layer;

(iv) changing the thicknesses of the ground; and/or (v) adding the cross-over and/or cross-under metal strips.

Accordingly, and advantageously, the CPW structures can be implemented for any characteristic impedance.

More specifically, the CPW structure of the present invention includes a three dimensional structure in signal layer and/or ground. The CPW structure, for example, is made by placing a wide (W1), short and thick (T2) line and a narrow (W2), short and thin (T1) line, in alternating fashion. In embodiments, the signal layer may include, for example, placing a thick (T2) line and thin (T1) line, in alternating fashion, with a constant width dimension. The slow wave effect can be changed by using different W1, W2, T1, T2 values and ratios, different separations, pitch, and/or adding floating strips above and below the CPW structure. The CPW structure of the present invention can be implemented for any characteristic impedance.

By way of background, from the transmission line theory, the wavelength λ, a phase velocity "v " and characteristics impedance Zo are given respectively as:

$$\lambda = \frac{v}{f} \tag{1}$$

$$v \propto \frac{1}{\sqrt{LC}} \tag{2}$$

$$Zo = (L/C)^{1/2} \tag{3}$$

where f is the wave's frequency, L and C are the inductance and capacitance per unit length, respectively, v is the magnitude of phase velocity and λ is the wavelength.

From the above equations, the wavelength can be made smaller while the characteristic impedance is kept unchanged by increasing L and C with the same ratio. Also, increasing either or both the inductance L and/or capacitance C will decrease the velocity v and hence the wavelength λ. And, decreasing the wavelength λ will physically reduce the dimension of passive components such as branchline coupler which includes four quarter wavelength arms, thereby reducing the chip space needed for the CPW structure and components built with them.

Figure 1B:
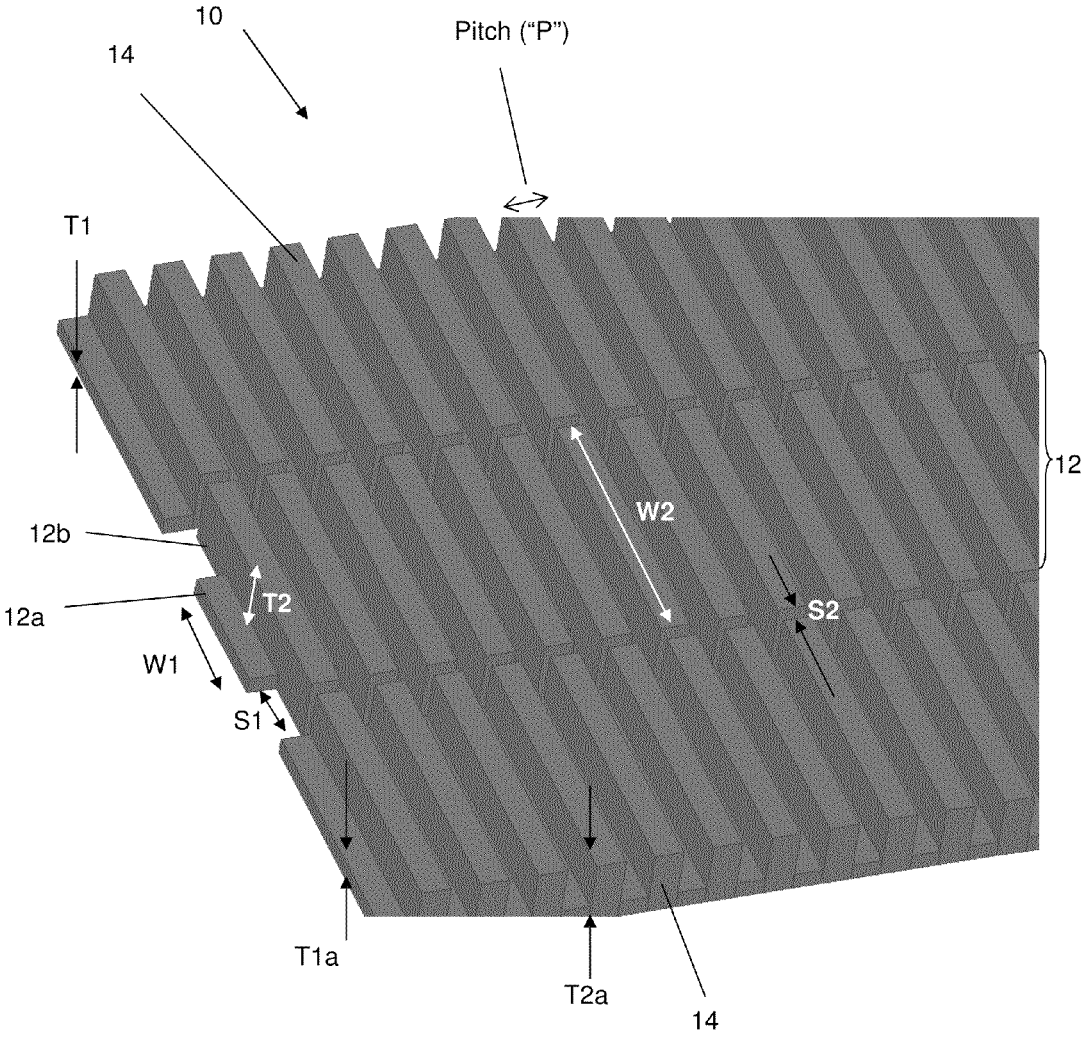

FIGS. 1*a* and 1*b* show a slow-wave coplanar waveguide structure in accordance with aspects of the invention. More specifically, FIGS. 1*a* and 1*b* shows a slow-wave coplanar waveguide (CPW) structure 10 having a signal layer 12 with alternating narrow portions 12*a* and wide portions 12*b*. The signal layer 12 is formed on the same plane as at least one ground 14. In embodiments, the at least one ground 14 can be on either or both sides of the signal layer 12. Hereinafter, the present invention will be described using two grounds, however, it should be understood by those of skill in the art that a single ground could also be implemented with any aspects of the present invention.

The signal layer 12 and grounds 14 can be formed using conventional lithographic, etching and deposition processes, commonly employed in CMOS fabrication. For example, a resist can be placed over an insulating layer and exposed to light to form patterns, corresponding with the shapes of the signal layer 12 and the grounds 14. The exposed regions of the insulating layer are then etched to form trenches using conventional processes such as, for example, reactive ion etching. A metal or metal alloy layer is then deposited in the trenches to form the signal layer 12 and grounds 14. The signal layer 12 and grounds 14 can be formed of any known metal or metal alloy, suitable for its particular purpose.

FIG. 1*b* shows an exploded view of the CPW structure of FIG. 1*a*, in accordance with aspects of the invention. FIG. 1*b* more specifically shows the dimensions W1, W2 and T1, T2 of the alternating narrow portions 12*a* and wide portions 12*b*, as well as the spacing S1, S2 between the narrow and wide portions and grounds 14, respectively. FIG. 1*b* also shows the grounds 14 with a uniform width; however, the grounds can have a varying thickness T1*a*, T2*a* along its length.

More specifically, the narrow portions 12*a* have a width W1 and the wide portions 12*b* have a width W2, where W2>W1. The widths of the narrow portions 12*a* and the wide portions 12*b* can vary such as, for example, between about 0.25 microns to 100 microns. Also, the narrow portions 12*a* have a thickness T1 and the wide portions 12*b* have a thickness T2, where T2>T1. The thickness of the narrow portions 12*a* and the wide portions 12*b* can vary such as, for example, between about 10 nm to 20 microns. In embodiments, the thickness of T1 can be about 2 to 20 times smaller than T2, for example. In any of the aspects of the invention, W2 can equal W1, when T2>T1 (which can be represented by FIG. 1*a*, for example, as the figure is not to scale).

The ground 14 can have a uniform width, but a varied thickness. For example, the dimensions T1*a*, T2*a* of the ground 14 can be 10 nm to 20 microns. In embodiments, the thickness of T1*a* can be about 2 to 20 times smaller than T2*a*, for example. In embodiments, the thickness T1*a* corresponds to the thickness T1, and the thickness T2*a* corresponds to the thickness T2*a*. In further embodiments, the wires with the corresponding thicknesses should be in alignment in a same or substantially same plane.

The spacing (separation) between the narrow portion 12*a* and the ground 14 is represented by S1; whereas, the spacing (separation) between the wide portion 12*b* and the ground 14 is represented by S2. In embodiments, S1>S2, with the spacing of S1 and S2 being capable of varying depending on the widths W1 and W2 of the alternating narrow portions 12*a* and wide portions 12*b*. For example, as width W1 becomes smaller, spacing S1 becomes larger.

FIG. 1*b* also shows a pitch "P" comprising a narrow portion 12*a* and wide portion 12*b*. In embodiments, the pitch "P" can vary from, for example, about 1 micron to about 50 microns. That is, one narrow portion 12*a* and one wide portion 12*b* may have a spacing of about 1 micron; whereas, one narrow portion 12*a* and one wide portion 12*b* can also have a spacing of about 50 microns. Varying the pitch P can be used to tune the structure 10. For example, a small pitch will increase both capacitance C and inductance L, as well as increase the slow-wave effect.

Inductance and capacitance of the CPW structure 10 can be tuned by varying the widths W1, W2 and, hence, the spacing S1, S2 between the signal layer 12 and the grounds 14, as well as the thickness T1, T2 (and/or T1*a*, T2*a*). For example, inductance L of the CPW structure 10 is decided by the narrower signal layer (W1) and the larger spacing (S1); whereas, capacitance C of the CPW structure may be decided by the wider signal layer (W2) and the smaller spacing (S2). More specifically, a larger inductance L can be achieved as width W1 becomes smaller and spacing S1 becomes larger, and the thickness T1 and/or T1*a* of the metal line(s) become smaller. Likewise, a larger capacitance C can be achieved as width W1 becomes larger and S1 becomes smaller, and thickness T1 and/or T1*a* of metal line(s) become thicker. Thus, by changing the values of W1, W2, S1 and S2, as well as T1, T2 and/or T1*a*, T2*a*, different L and C values can be achieved, resulting in different characteristic impedance and changing or tuning the slow-wave effect. Cross-over and/or cross-under strips can also be used to improve the slow-wave effect.

In other words, from the above equations, the wavelength can be made smaller while the characteristic impedance is kept unchanged by increasing L and C with the same ratio. That is, when the pitch "P" is very small compared with the wavelength, L is mainly determined by the narrower line width W1, thickness T1 and larger spacing S1 between signal layer 12 and ground 14, while capacitance C is determined by the larger line width W2, thicker metal line T2 and the smaller spacing S2 between signal layer 12 and ground 14. Accordingly, as shown in FIGS. 1*a* and 1*b*, the width W1 and thickness T1 are small and the spacing S1 is large, so larger inductance L can be achieved. Also, the width W2 and thickness T2 is large and spacing S2 is small, so a larger capacitance C can be achieved. Thus, by changing the values of W1, W2, S1, S2, T1 and T2 (or T1*a* and T2*a*), different inductance L and capacitance C values can be achieved and so will the different characteristics impedance, thereby making it possible to change the slow wave effect.

Figure 2:
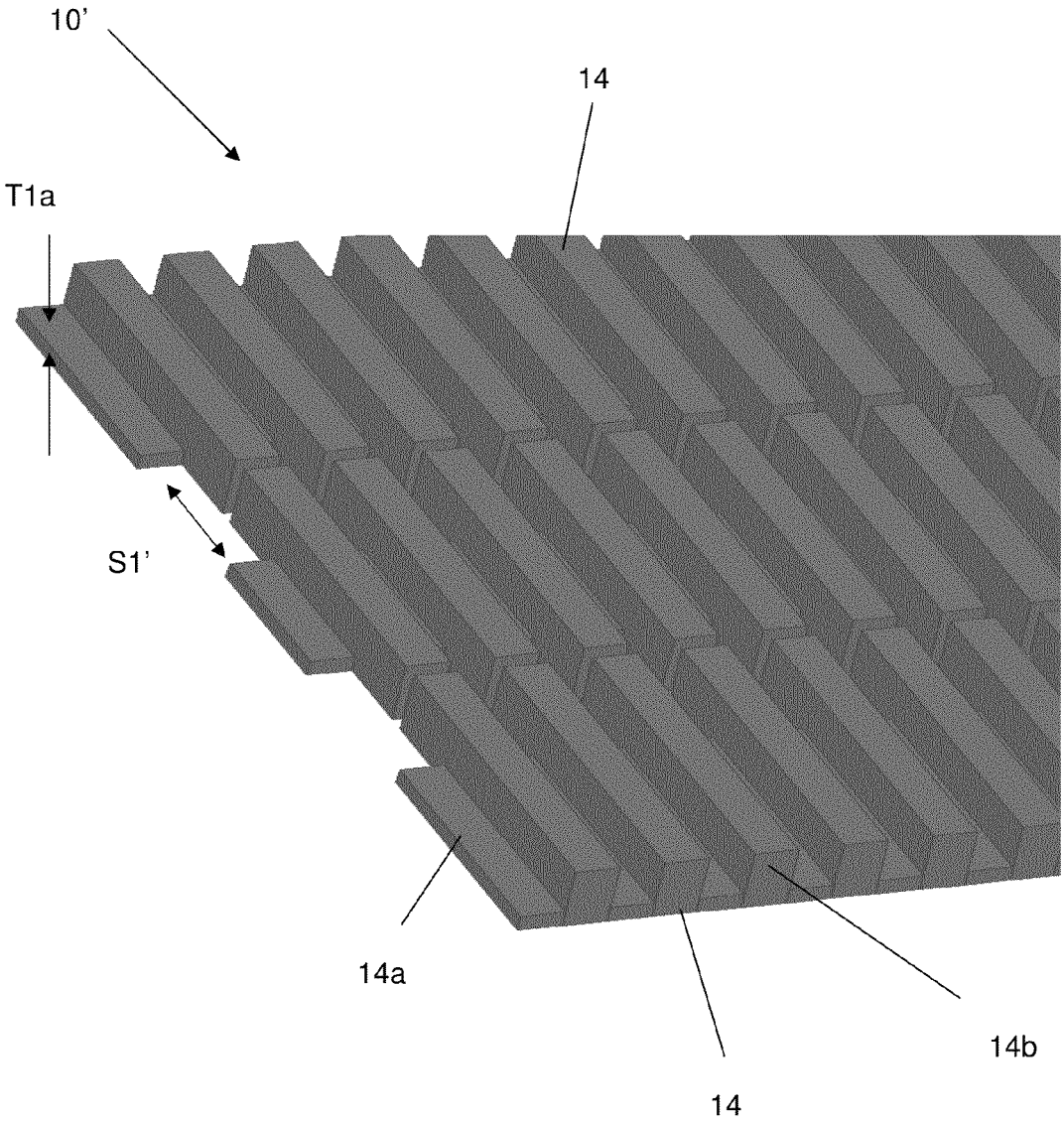
FIG. 2 shows a slow-wave coplanar waveguide structure in accordance with additional aspects of the invention.

FIG. 2 shows a slow-wave coplanar waveguide (CPW) structure 10' in accordance with aspects of the invention. In this structure, the CPW structure 10' includes a larger space S1' This is accomplished by adjusting (shortening), for example, a width of the thinner portion T1*a* of the ground 14. By making the space S1' larger, it is possible to increase the inductance. More specifically, in this embodiment, the ground 14 includes smaller (narrower) portions 14*a* and larger (wider) portions 14*b*. The smaller (narrower) portions 14*a* and larger (wider) portions 14*b* will increase the slow-wave effect by adjusting the separation between the ground and signal layers, e.g., having a larger separation S1'. That is, the larger separation (spacing) S1' will increase the inductance L and, hence, increase the slow-wave effect. The structures of any of the embodiments can be bended or folded to form meandering lines, as another way of tuning the CPW structure.

Figure 3:
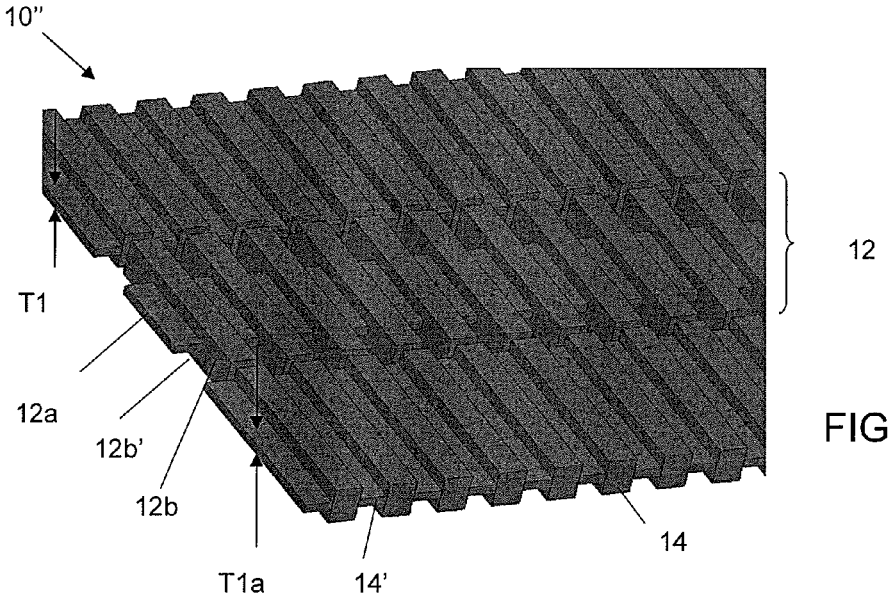
FIG. 3 shows a slow-wave coplanar waveguide structure in accordance with additional aspects of the invention.

FIG. 3 shows a slow-wave coplanar waveguide (CPW) structure in accordance with aspects of the invention. In this structure, the CPW structure 10" is a variant of the CPW structure 10 shown in FIGS. 1*a* and 1*b*. For example, in this embodiment, the narrow portion 12*a* (e.g., thinner portion T1) of the signal layer 12 is provided (or formed) in a mid portion 12*b*' of the wide portion 12*b* of the signal layer 12 (measured between a top surface and a bottom surface) and the thin portion T1*a* of the ground 14 is provided (or formed) in the mid portion 14' of the thicker portion (measured between a top surface to a bottom surface). In this way, the thin portions T1 and T1*a* remain in the same plane. In further embodiments, the thin portions T1 and T1*a* can be provided at a top surface, bottom surface or other portion of the structure, while remaining in the same plane.

In embodiments, the placement of the thin portions T1 and T1*a* can depend on design requirements and available options of back end of line (BEOL) metal layers such as, for example, the placement of other wiring layers. For example, in embodiments, the thinner portions T1 and T1*a* can be placed at a top surface of the structure in order to be closer to upper wiring layers, for connecting thereto. Also, it should be understood that the different thickness lines and positions thereof may be formed by using multiple metal levels (e.g., thickness T2 is formed on a metal layer, while thickness T1 is formed using the combination of metal layers and via.

Figure 4:
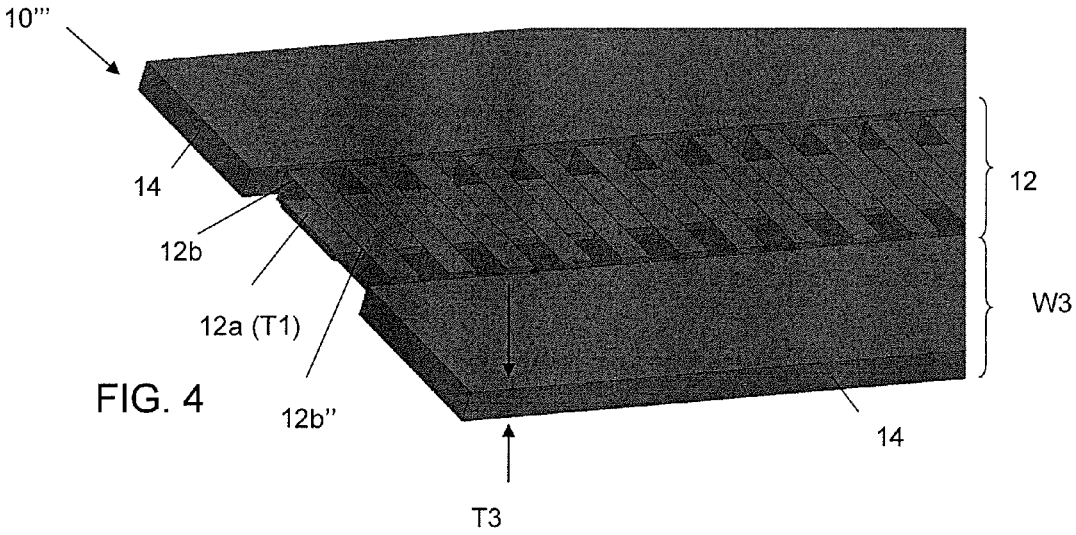
FIG. 4 shows a slow-wave coplanar waveguide structure in accordance with additional aspects of the invention.
Figure 5:
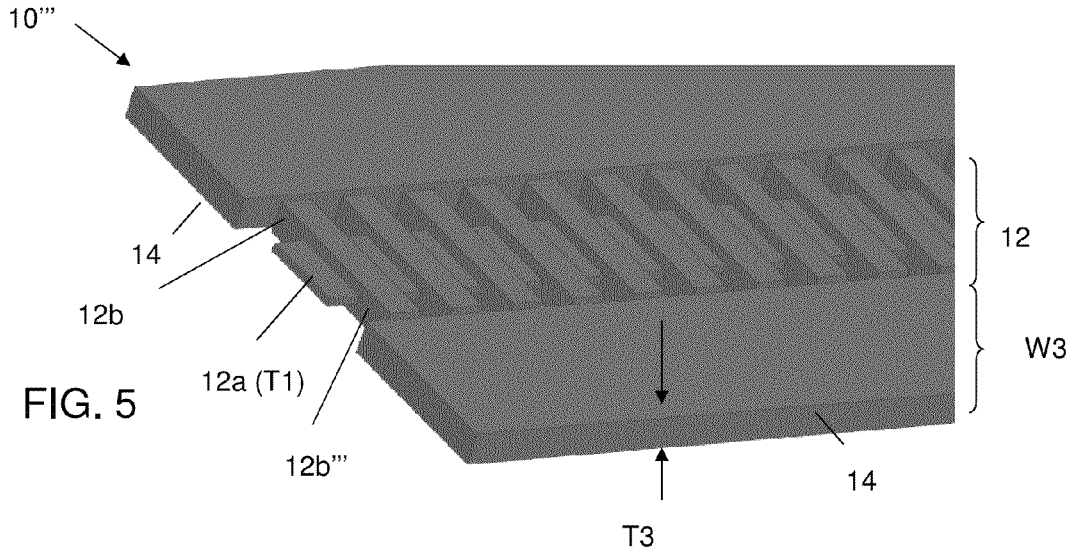
FIG. 5 shows a slow-wave coplanar waveguide structure in accordance with additional aspects of the invention.

FIGS. 4 and 5 show exploded views of the slow-wave coplanar waveguide structure in accordance with aspects of the invention. In FIGS. 4 and 5, for example, the CPW structure 10'" shows a ground 14 with a uniform thickness T3, throughout its length. In FIG. 4, the narrow portions 12*a* (e.g., thinner portion T1) is provided (or formed) at a top surface (or bottom, depending on perspective) 12*b*" of the wide portion 12*b*of the signal layer 12, and the ground 14 has a uniform thickness T3 and width W3. In FIG. 5, the narrow portions 12*a* (e.g., thinner portion T1) of the signal layer 12 is provided (or formed) in a mid portion 12*b*'" of the wide portion 12*b* of the signal layer 12 (measured between the top surface and the bottom surface) and the ground 14 has a uniform thickness T3 and width W3.

Figure 6:
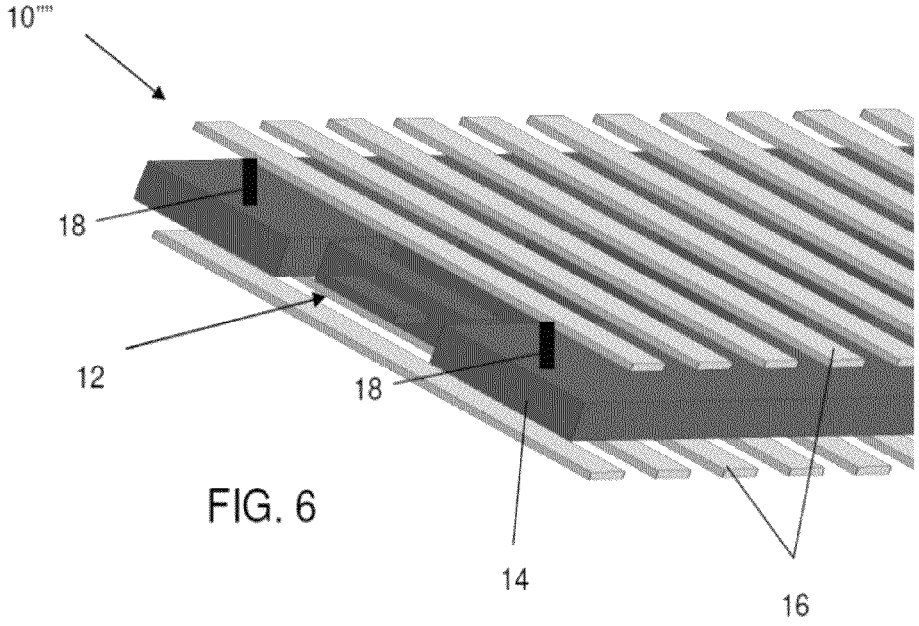
FIG. 6 shows a slow-wave coplanar waveguide structure in accordance with additional aspects of the invention.

FIG. 6 shows a slow-wave coplanar waveguide (CPW) structure in accordance with aspects of the invention. In this structure, the CPW structure 10'"" includes metal strips (e.g., conductive wires) 16 crossing over the wide portion of the signal layer 12 (e.g., formed on another wiring level), which are connected (coupled) with the ground 14 by vias 18 to further increase the capacitance C of the structure. Accordingly, an improved slow-wave effect can be achieved using the metal strips 16. In embodiments, the metal strips (e.g., conductive wires) 16 can also or alternatively be formed under the wide portion of the signal layer 12 (e.g., formed on another wiring level), which is partially shown in FIG. 6. In embodiments, the metal strips 16 and vias 18 can be formed using conventional CMOS fabrication methodologies such as, for example, lithographic, etching and deposition processes, as discussed above.

It should also be understood that any of the slow wave CPW structures thus shown and described can be bended or folded to build meandering lines In this way, for further increase in the slow wave effect, a deflected ground structure (or signal layer) can be used to obtain larger separation between the ground 14 and signal layer 12. This can dramatically increase the inductance L and, likewise, increase the slow wave effect.

FIGS. 7-11 show various performance graphs of structures in accordance with aspects of the invention. Graphs 7 and 8 show two lines "A" and "B", where line "A" is representative, for example, of the embodiment shown in FIGS. 1*a* and 1*b*; whereas, line "B" is representative, for example, of a conventional structure, e.g., uniform width of the signal layer and spacing between the signal layer and grounds, in addition to uniform thickness. More specifically, in these examples, line "A" represents a signal layer having:

(i) a width W1 of 10 microns and corresponding spacing S1 of 6 microns;

(ii) a width W2 of 20 microns and corresponding spacing S2 of 1 micron;

(iii) a thickness T1 of 1.25 microns and a thickness T2 of 5 microns; and (iv) a pitch of 4 microns.

Figure 7:
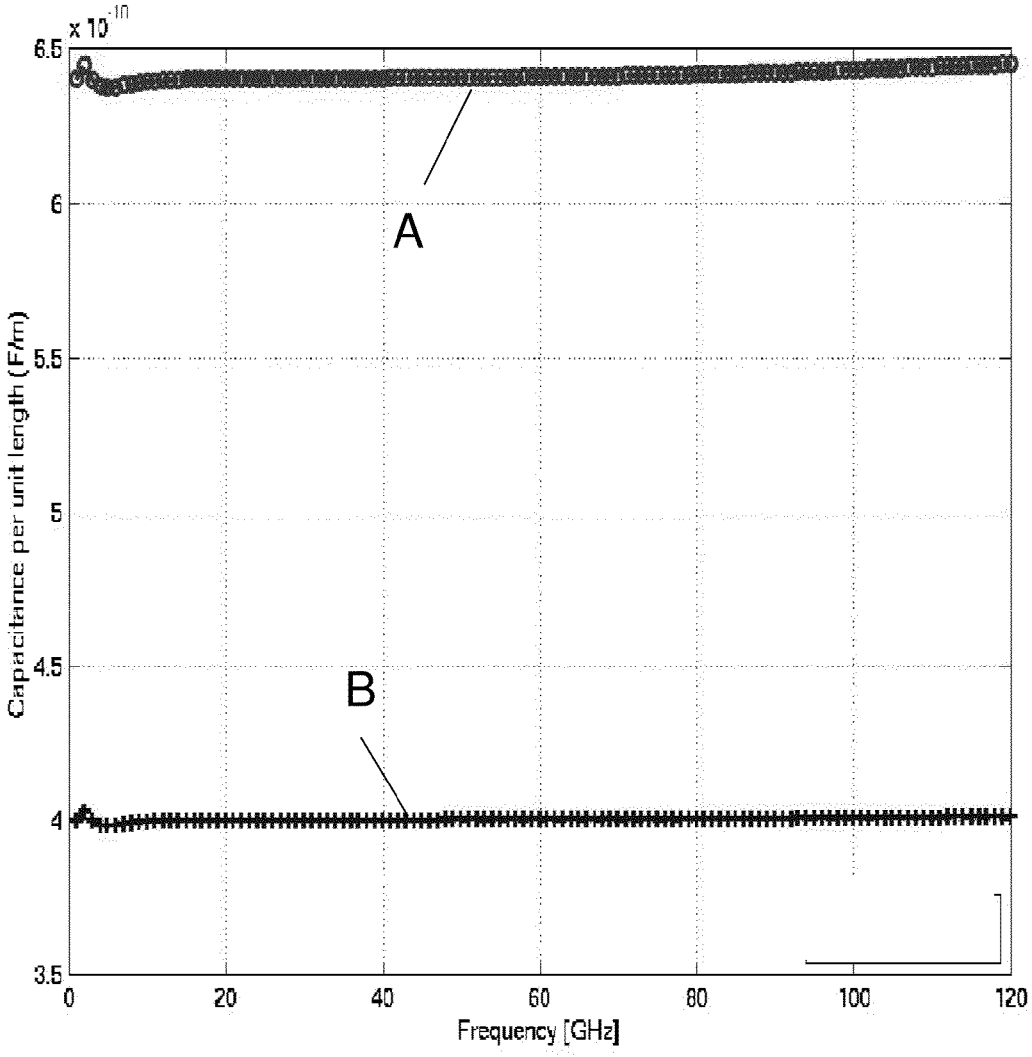
FIGS. 7-11 show various performance graphs of structures in accordance with aspects of the invention.

FIG. 7 shows a comparison of capacitance (per unit length in F/m) vs. frequency for the CPW structures described above and a signal layer with a different width and a uniform thickness (conventional step slowwave structure). As shown in this representative graph, the CPW structure represented by line "A" shows the highest capacitance per unit length in F/m. On the other hand, the CPW structure with the uniform thickness, and spacing shows a lower capacitance. As shown in FIG. 7, for example, there is over 62.5% capacitance per unit length improvement with almost constant inductance per unit length, e.g., less than 10% reduction.

Figure 8:
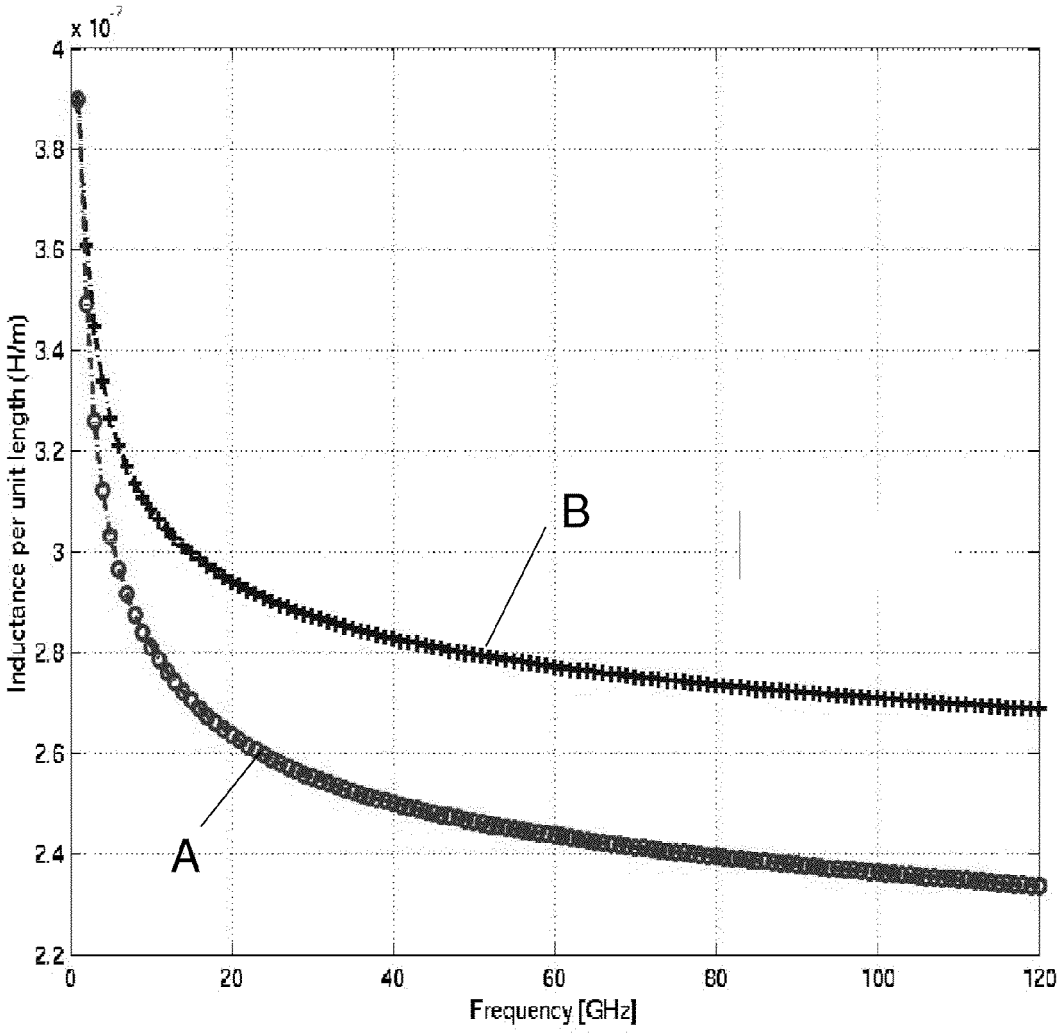

FIG. 8 shows a comparison of inductance (in H/m) vs. frequency (in GHz) between the CPW structures described above and a signal layer with a uniform thickness (conventional step slow wave structure). As shown in this representative graph, the CPW structure represented by line "A" shows the lower inductance and the CPW structure represented by line "B" shows the highest inductance, i.e., the conventional CPW structure with the uniform thickness.

Figure 9:
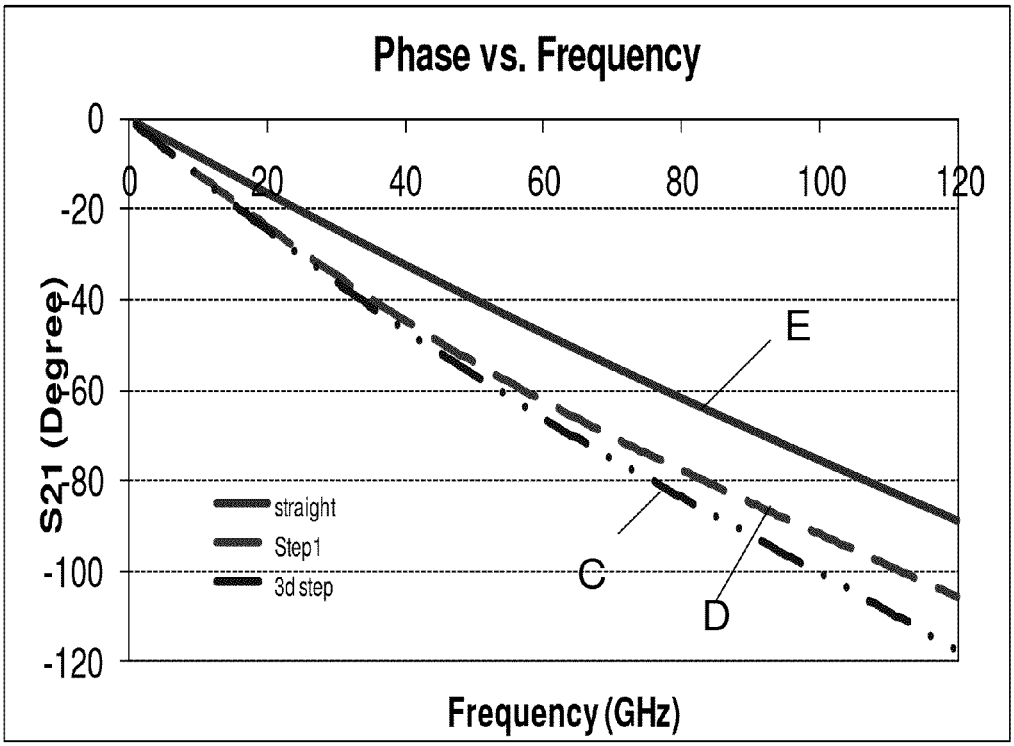

FIG. 9 shows a comparison graph of phase (i.e., S21 in degrees) vs. frequency, (in GHz), implementing the structures of the present invention. In FIG. 9, line "C"(also designated as "3d step " ) represents the CPW structures of the present invention; whereas, line "D" (also designated as "step 1")is representative of a CPW structure with different spacing (due to different widths W1, W2) and line "E" (also designated as "straight") is a conventional structure with a signal layer having a uniform width and thickness. In FIG. 9, the length of the signal layer is 202 microns, as an illustrative, non-limiting example. As shown, the phase change is 88° and 118° for the CPW structure represented by lines "C" and "D", respectively, thus showing an improvement for each structure over that of a conventional CPW structure. The CPW structure of the present invention shows the greatest improvement.

Figure 10:
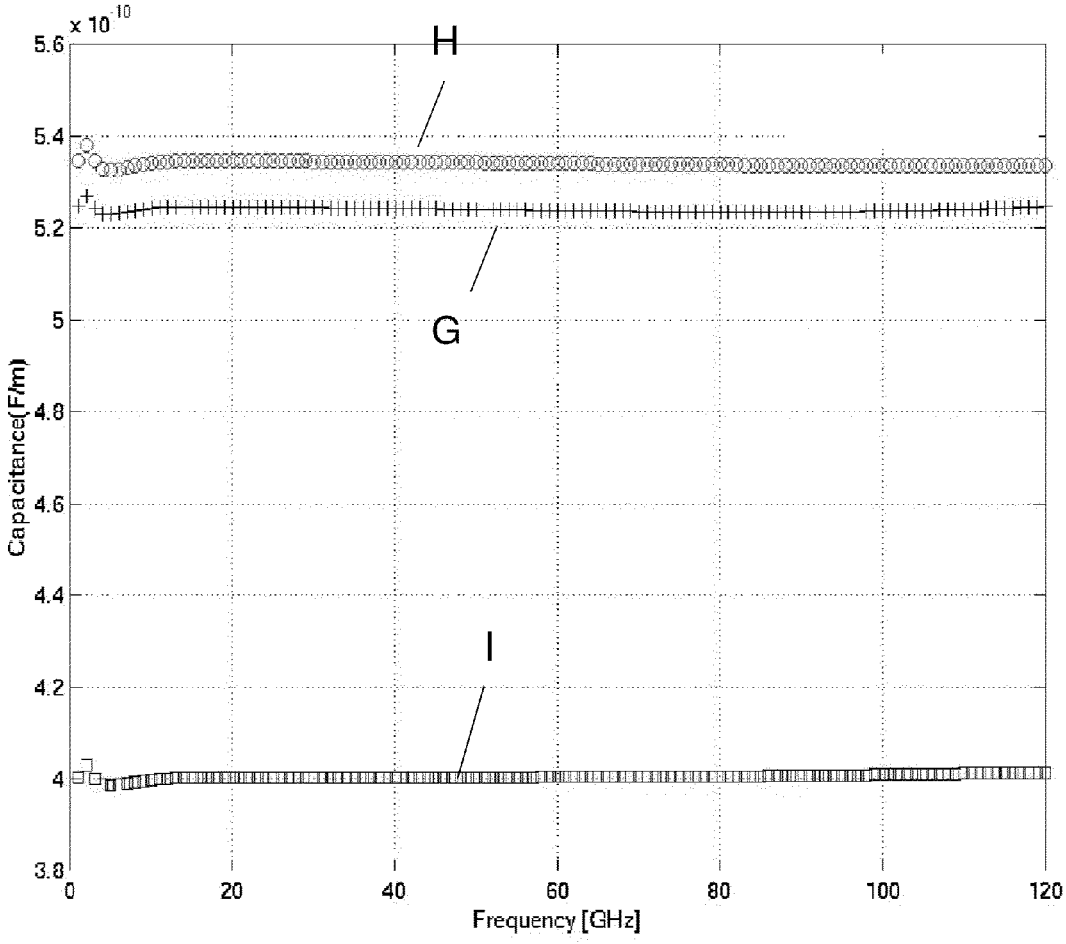
Figure 11:
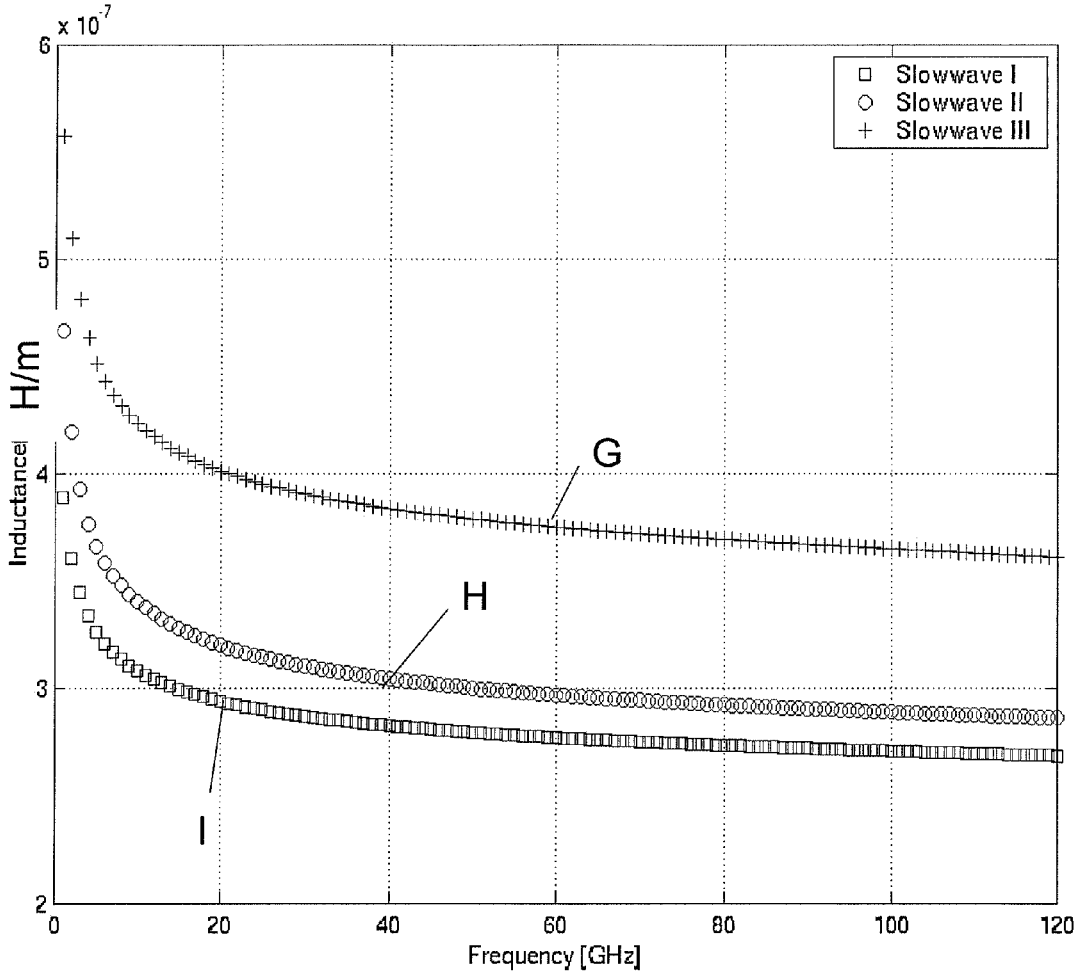

FIG. 10 shows a comparison of capacitance (in F/m) vs. frequency (in GHz) between the CPW structures described above and a signal layer with a uniform width and thickness (conventional structure). FIG. 11 shows a comparison of inductance (in H/m) vs. frequency (in GHz) for the CPW structures described above and a signal layer with a uniform width and thickness (conventional structure).

FIGS. 10 and 11 show three lines "G", "H" and "I", where line "G" is representative, for example, of the embodiments shown in FIGS. 1*a*, 3 and 6, line "H" is representative, for example, of the embodiments shown in FIGS. 1*b* and 2, and line "I" is representative of a structure that has a uniform thickness of the signal layer and different spacing between the signal layer and grounds. More specifically, in these examples, lines "G" represents a signal layer having a spacing S1 of 1 micron and S2 of 6 microns, and "H" represents a signal layer having a spacing S1 of 1 micron and S2 of 11 microns FIG. 10 shows a comparison of capacitance (in F/m) vs. frequency (in GHz) between the CPW structures described above and a signal layer with a uniform thickness. As shown in this representative graph, the CPW structure represented by line "H" shows the highest capacitance and the CPW structure represented by line "G" shows the second highest capacitance. On the other hand, the CPW structure with the uniform thickness shows the lowest capacitance, i.e., CPW structure represented by line "I".

FIG. 11 shows a comparison of inductance (in H/m) vs. frequency (in GHz) for the CPW structures described above and a signal layer with a uniform width (spacing) and thickness. As shown in this representative graph, the CPW structure represented by line "G" shows the highest inductance and the CPW structure represented by line "H" shows the second highest inductance. On the other hand, the CPW structure with the uniform thickness shows the lowest inductance, i.e., CPW structure represented by line "I".

Accordingly, it should be understood by those of skill in the art, after reading the present disclosure, that slow wave effect of the CPW structures of the present invention can be tuned by, for example:

changing the pitch of each cell;

changing the width difference ratio of the signal layer and/or grounds resulting in a change in separation between the signal layer and ground (at either or both the narrow or wide signal layer and ground);

changing the thickness of the wide and narrow part of the signal layer;

changing the thickness of the ground; and/or adding the cross over and/or cross under metal strips.

Figure 12:
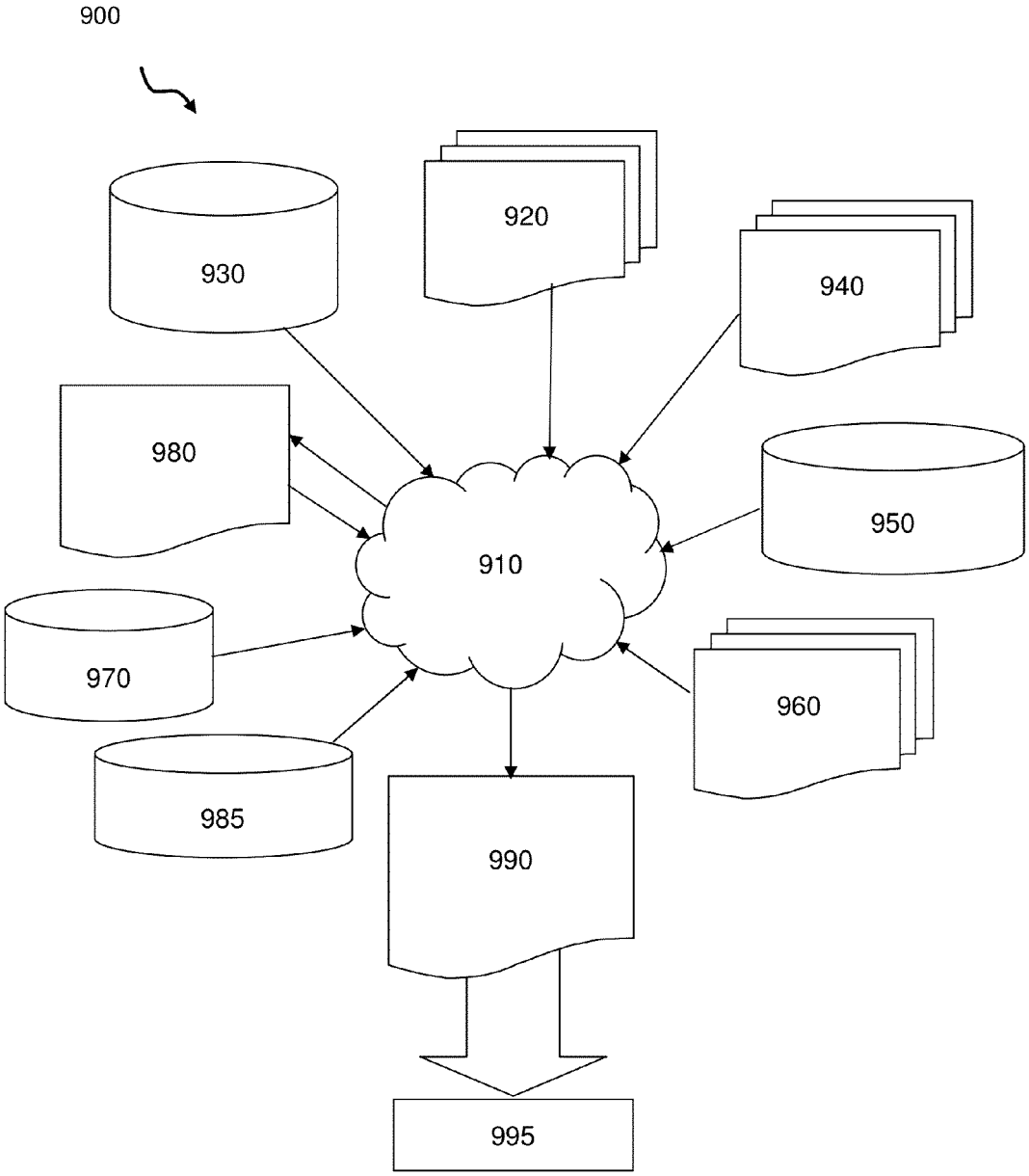
FIG. 12 is a flow diagram of a design process used in semiconductor design, manufacture, and/or test.

FIG. 12 is a flow diagram of a design process used in semiconductor design, manufacture, and/or test. FIG. 12 shows a block diagram of an exemplary design flow 900 used for example, in semiconductor IC logic design, simulation, test, layout, and manufacture. Design flow 900 includes processes, machines and/or mechanisms for processing design structures or devices to generate logically or otherwise functionally equivalent representations of the design structures and/or devices described above and shown in FIGS. 1*a*, 1*b* and 2-6. The design structures processed and/or generated by design flow 900 may be encoded on machine-readable transmission or storage media to include data and/or instructions that when executed or otherwise processed on a data processing system generate a logically, structurally, mechanically, or otherwise functionally equivalent representation of hardware components, circuits, devices, or systems. Machines include, but are not limited to, any machine used in an IC design process, such as designing, manufacturing, or simulating a circuit, component, device, or system. For example, machines may include: lithography machines, machines and/or equipment for generating masks (e.g. e-beam writers), computers or equipment for simulating design structures, any apparatus used in the manufacturing or test process, or any machines for programming functionally equivalent representations of the design structures into any medium (e.g. a machine for programming a programmable gate array).

Design flow 900 may vary depending on the type of representation being designed. For example, a design flow 900 for building an application specific IC (ASIC) may differ from a design flow 900 for designing a standard component or from a design flow 900 for instantiating the design into a programmable array, for example a programmable gate array (PGA) or a field programmable gate array (FPGA) offered by manufacturers such as Altera® Inc. or Xilinx® Inc.

FIG. 12 illustrates multiple such design structures including an input design structure 920 that is preferably processed by a design process 910. Design structure 920 may be a logical simulation design structure generated and processed by design process 910 to produce a logically equivalent functional representation of a hardware device. Design structure 920 may also or alternatively comprise data and/or program instructions that when processed by design process 910, generate a functional representation of the physical structure of a hardware device. Whether representing functional and/or structural design features, design structure 920 may be generated using electronic computer-aided design (ECAD) such as implemented by a core developer/designer. When encoded on a machine-readable data transmission, gate array, or storage medium, design structure 920 may be accessed and processed by one or more hardware and/or software modules within design process 910 to simulate or otherwise functionally represent an electronic component, circuit, electronic or logic module, apparatus, device, or system such as those shown in FIGS. 1*a*, 1*b* and 2-6. As such, design structure 920 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 910 preferably employs and incorporates hardware and/or software modules for synthesizing, translating, or otherwise processing a design/simulation functional equivalent of the components, circuits, devices, or logic structures shown in FIGS. 1*a*, 1*b* and 2-6 to generate a netlist 980 which may contain design structures such as design structure 920. Netlist 980 may comprise, for example, compiled or otherwise processed data structures representing a list of wires, discrete components, logic gates, control circuits, I/O devices, models, etc. that describes the connections to other elements and circuits in an integrated circuit design. Netlist 980 may be synthesized using an iterative process in which netlist 980 is resynthesized one or more times depending on design specifications and parameters for the device. As with other design structure types described herein, netlist 980 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 910 may include hardware and software modules for processing a variety of input data structure types including netlist 980. Such data structure types may reside, for example, within library elements 930 and include a set of commonly used elements, circuits, and devices, including models, layouts, and symbolic representations, for a given manufacturing technology (e.g., different technology nodes, 32 nm, 45 nm, 90 nm, etc.). The data structure types may further include design specifications 940, characterization data 950, verification data 960, design rules 970, and test data files 985 which may include input test patterns, output test results, and other testing information. Design process 910 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 910 without deviating from the scope and spirit of the invention. Design process 910 may also include modules for performing standard circuit design processes such as timing analysis, verification, design rule checking, place and route operations, etc.

Design process 910 employs and incorporates logic and physical design tools such as HDL compilers and simulation model build tools to process design structure 920 together with some or all of the depicted supporting data structures along with any additional mechanical design or data (if applicable), to generate a second design structure 990.

Design structure 990 resides on a storage medium or programmable gate array in a data format used for the exchange of data of mechanical devices and structures (e.g. information stored in a Initial Graphics Exchange Specification (IGES), DXF (Drawing Interchange Format), Parasolid XT, JT, DRG (DraWinG), or any other suitable format for storing or rendering such mechanical design structures). Similar to design structure 920, design structure 990 preferably comprises one or more files, data structures, or other computer-encoded data or instructions that reside on transmission or data storage media and that when processed by an ECAD (Electronic design automation) system generate a logically or otherwise functionally equivalent form of one or more of the embodiments of the invention shown in FIGS. 1*a*, 1*b* and 2-6. In one embodiment, design structure 990 may comprise a compiled, executable HDL simulation model that functionally simulates the devices shown in FIGS. 1*a*, 1*b* and 2-6.

Design structure 990 may also employ a data format used for the exchange of layout data of integrated circuits and/or symbolic data format (e.g. information stored in a GDSII (graphic Database System II) (GDS2), GL1(Global Area 1), OASIS,(Open Atrwork System Interchange Standard), map files, or any other suitable format for storing such design data structures). Design structure 990 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 1*a*, 1*b* and 2-6. Design structure 990 may then proceed to a stage 995 where, for example, design structure 990: proceeds to tape-out(e.g., final result of the design cycle), is released to manufacturing, is released to a mask house, is sent to another design house, is sent back to the customer, etc.

The method as described above is used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims, if applicable, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principals of the invention and the practical application, and to enable others of ordinary skill in the art to understand the invention for various embodiments with various modifications as are suited to the particular use contemplated. Accordingly, while the invention has been described in terms of embodiments, those of skill in the art will recognize that the invention can be practiced with modifications and in the spirit and scope of the appended claims.

What is claimed:

1. A structure, comprising:

at least one ground; and a signal layer provided in a same plane as the at least one ground, the signal layer having at least one alternating wide portion and narrow portion with an alternating thickness, the wide portion extending toward the at least one ground, wherein the narrow portion has a first thickness T1 and the wide portion has a second thickness T2, wherein T1<T2.

2. The structure of claim 1, wherein the narrow portion has a width W1 and the wide portion has a width W2, wherein W2>W1.

3. The structure of claim 1, wherein the at least one ground has portions of varying thickness along the length thereof.

4. The structure of claim 3, wherein the varying thickness is a first thickness T1*a*at a first portion and a second thickness T2*a* at second portion, wherein T1*a*<T2*a*.

5. The structure of claim 4, wherein the first portion and the narrow portion are in alignment with each other.

6. The structure of claim 1, wherein the at least one ground is two grounds.

7. The structure of claim 6, wherein the at least one ground has a substantially uniform width and one of a varying thickness and a constant thickness along the length thereof.

8. The structure of claim 1, further comprising a spacing S1 between the narrow portion and the at least one ground and a spacing S2 between the wide portion and the at least one ground, wherein S1>S2.

9. A structure, comprising:

at least one ground;

a signal layer provided in a same plane as the at least one ground, the signal layer having at least one alternating wide portion and narrow portion with an alternating thickness, the wide portion extending toward the at least one ground; and at least one of:

a cross-under conductive structure positioned under the signal layer and coupled to the at least one ground; and a cross-over conductive structure positioned over the signal layer and coupled to the at least one ground.

10. A structure, comprising:

at least one ground; and a signal layer provided in a same plane as the at least one ground, the signal layer having at least one alternating wide portion and narrow portion with an alternating thickness, the wide portion extending toward the at least one ground, wherein the at least one ground has alternating narrow portions and wide portions coinciding with the at least one alternating narrow portion and wide portion, respectively, of the signal layer.

11. A method of tuning a coplanar waveguide structure, comprising tuning at least one of a capacitance and inductance of the coplanar waveguide structure by adjusting a thickness between at least one of a wide portion and a narrow portion of a signal layer and a spacing between at least one of the wide portion and the narrow portion of the signal layer and a ground, and the ground which is in a same plane as the signal layer and providing at least one of a conductive wiring underneath the signal layer and a conductive wiring over the signal layer.

12. A slow wave coplanar waveguide (CPW) structure, comprising:

a signal layer having portions with different thicknesses T1, T2 and different widths; and at least one ground line adjacent to and in a same plane as the signal layer which includes one of:

portions of different thicknesses corresponding in size to the different thicknesses T1, T2 of the signal layer; and a uniform thickness; and at least one of:

a cross-under conductive structure positioned under the signal layer and coupled to the at least one ground line; and a cross-over conductive structure positioned over the signal layer and coupled to the at least one ground line.

13. A method of tuning a coplanar waveguide structure, comprising tuning at least one of a capacitance and inductance of the coplanar waveguide structure by adjusting a thickness between at least one of a wide portion and a narrow portion of a signal layer and a spacing between at least one of the wide portion and the narrow portion of the signal layer and a ground, and the ground which is in a same plane as the signal layer; and providing at least one of:

a cross-under conductive structure under the signal layer and coupled to the ground; and a cross-over conductive structure positioned over the signal layer and coupled to the ground.

14. The method of claim 13, further comprising adjusting a width of the ground.

15. The method of claim 13, wherein the narrow portion has a first thickness T1 and the wide portion has a second thickness T2, wherein T1<T2.

16. The method of claim 13, further comprising adjusting a thickness of portions of the ground such that a thickness of the signal layer corresponds with a thickness of the narrow portion of the signal layer.

17. A design structure readable by a machine used in designing, manufacturing, or testing of an integrated circuit, the design structure comprising a functional representation of:

at least one ground; and a signal layer provided in a same plane as the at least one ground, the signal layer having at least one alternating wide portion and narrow portion with an alternating thickness, the wide portion extending toward the at least one ground, wherein the narrow portion has a first thickness T1 and the wide portion has a second thickness T2, wherein T1<T2.

18. The design structure of claim 17, wherein the design structure comprises a netlist.

19. The design structure of claim 17, wherein the design structure resides in a storage medium as a data format used for the exchange of layout data of integrated circuits.

20. The design structure of claim 17, wherein the design structure resides in a programmable gate array.

* * * * *